United States Patent [19]

Mattei

[11] Patent Number: 4,595,026

[45] Date of Patent: Jun. 17, 1986

[54] CIGARETTE MANUFACTURING METHOD AND MACHINE WITH SHORT TOBACCO DISTRIBUTION CONTROL

[75] Inventor: Riccardo Mattei, Bologna, Italy

[73] Assignee: G.D Societa' per Azioni, Bologna, Italy

[21] Appl. No.: 679,690

[22] Filed: Dec. 10, 1984

[30] Foreign Application Priority Data

Dec. 20, 1983 [IT] Italy ..... 3661 A/83

[51] Int. Cl.[4] ..... A24C 5/14; A24C 5/39

[52] U.S. Cl. ..... 131/109.1; 131/84.3; 131/109.2; 131/110

[58] Field of Search ..... 131/84.3, 84.4, 109.1, 131/109.2, 109.3, 108

[56] References Cited

U.S. PATENT DOCUMENTS

| | | | |
|---|---|---|---|
| 4,095,604 | 6/1978 | Labbe | 131/109.1 |
| 4,185,644 | 1/1980 | Heitmann et al. | 131/109.3 |
| 4,330,001 | 5/1982 | Hodsall | 131/109.2 |
| 4,373,538 | 2/1983 | Steiniger | 131/109.1 |
| 4,499,909 | 2/1985 | Seragnoli | 131/84.4 |

FOREIGN PATENT DOCUMENTS 1101071 1/1968 United Kingdom .

*Primary Examiner*—V. Mullin
*Assistant Examiner*—H. Macey
*Attorney, Agent, or Firm*—Marshall, O'Toole, Gerstein, Murray & Bicknell

[57] ABSTRACT

Cigarette manufacturing method and machine with short tobacco distribution control, whereby the long and short tobacco in a mass of shredded tobacco is separated and fed along different routes to a belt supplying a continuous cigarette rod manufacturing unit; the short tobacco being fed through two containers arranged in line and communicating with each other through an adjustable-section opening, the first of the containers being a storage tank and the second a tank having an essentially constant tobacco level and from which the short tobacco flows out in proportion to the speed of the belt.

5 Claims, 1 Drawing Figure

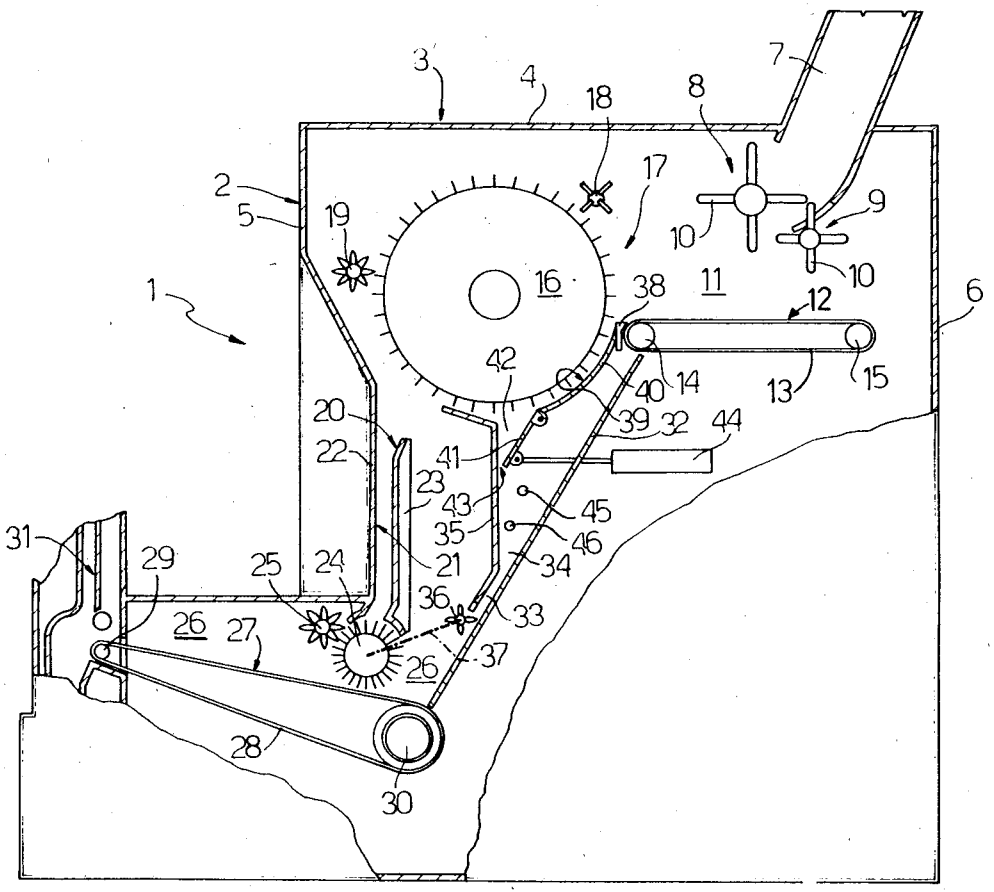
1
2
3
4
5
6
7
8
9
10
11
12
13
14
15
16
17
18
19
20
21
22
23
24
25
26
27
28
29
30
31
32
33
34
35
36
37
38
39
40
41
42
43
44
45
46

CIGARETTE MANUFACTURING METHOD AND MACHINE WITH SHORT TOBACCO DISTRIBUTION CONTROL

BACKGROUND OF THE INVENTION

The present invention relates to a cigarette manufacturing method providing for short tobacco distribution control. On cigarette manufacturing machines, cigarettes are known to be made starting from a continuous rod produced by folding a continuous strip of paper crosswise round a stream of shredded tobacco fed continuously on to the said strip of paper.

The physical characteristics of the cigarettes produced by cutting the said continuous rod crosswise are invariably inconsistent, at times varying considerably from one cigarette to another.

The cigarettes coming off the same machine and made from the same batch of tobacco invariably differ in weight, permeability and the extent to which the tobacco is held inside. Such differences are caused by the non-homogeneous nature of the tobacco and, consequently, of the stream of tobacco produced and deposited on to the said continuous strip of paper, the reason for this being uneven distribution of the different-size particles of which the tobacco is composed.

Shredded tobacco, in fact, is known to comprise relatively long strips, generally referred to as "long tobacco", and shorter strips, generally referred to as "short tobacco" and which usually also include tobacco dust.

The percentage of long or short tobacco not only varies from one batch of tobacco to another of the same quality, but also over time within the same batch, depending on the amount of handling the tobacco is subjected to.

Furthermore, the short tobacco in the mass is never evenly distributed, tending as it does to gravitate down through the thinner long tobacco and collect at the bottom.

Owing to poor blending of the long and short tobacco in the overall mass, the tobacco supply to the input feedbox on cigarette manufacturing machines usually results in a stream of tobacco in which the percentages of long and short tobacco vary in purely random "waves".

The inevitable drawback of such a situation is that the cigarettes coming off the machine differ as to physical characteristics, i.e. one cigarette may be produced containing a high percentage of long tobacco and, therefore, highly permeable and lightweight, whereas the next may contain a high percentage of short tobacco resulting in heavy weight, low permeability and poor hold, owing to the tendency of short tobacco to leak out if not held together by long tobacco.

In an attempt to overcome these drawbacks, cigarette manufacturing machines are known to be fitted with devices for regulating the distribution of short tobacco within the mass of tobacco being fed to the machine output.

Such a regulating device is described in British Pat. No. 1.101.071 which relates to a cigarette manufacturing machine on which, at a given point on the route travelled by the tobacco moving through the machine, the short tobacco is separated from the long tobacco and fed to a tank from which it is drawn off and fed to another point on the said tobacco route downstream from the said withdrawal point.

According to one feature of this machine, the stream of short tobacco coming out of the storage tank is regulated in such a manner as to be directly proportional to the amount of short tobacco collected inside the tank.

In this way, for example, if the machine is fed with a given quantity of predominantly short tobacco, the latter is drawn off from the mass of tobacco moving through the machine, with the result that a stream of essentially long tobacco is formed on the machine downstream from the said withdrawal point.

Subsequently, short tobacco is blended into the long-tobacco stream, the amount of short tobacco being proportional to the amount of the same collected in the storage tank. Consequently, the abovementioned known type of machine successfully provides for preventing the production of faulty cigarettes consisting essentially of short tobacco, by eliminating short-tobacco supply "peaks", which are redistributed by mixing short tobacco into the long-tobacco stream.

Though the abovementioned machine succeeds in preventing the production of faulty cigarettes consisting essentially of short tobacco, it should be pointed out that it definitely does not succeed in reducing the said differences in weight and permeability below a given level.

While, on the one hand, the abovementioned machine succeeds in ironing out the short-tobacco supply peaks, on the other, it most certainly does not succeed, for example, in making up for a shortage of such tobacco, should the machine be fed with a given quantity of predominantly long tobacco. In the event of this happening, the rate at which short tobacco is collected inside and fed out of the storage tank is essentially zero.

Consequently, for a given length of time, the cigarettes coming off the machine will consist mainly of long tobacco, the weight and permeability of which may differ to an unacceptable degree from cigarettes of the same type containing an appreciable percentage of short tobacco.

SUMMARY OF THE INVENTION

The aim of the present invention is to provide a method of manufacturing cigarettes containing essentially constant, preset percentages of long and short tobacco.

With this aim in view, the present invention relates to a method of manufacturing cigarettes and controlling the distribution of short tobacco, whereby shredded tobacco, comprising both long and short tobacco, is fed on to a collecting belt at the input of a unit for producing a continuous cigarette rod, the said method comprising stages consisting in:

dividing a mass of shredded tobacco, at a point upstream from the said collecting belt, in such a manner as to separate the long and short tobacco;

feeding the said long tobacco along a first route and, via extracting means, on to the said collecting belt, so as to form, on the said belt, a first essentially continuous stream of tobacco;

feeding the said short tobacco along a second route comprising a first and second container arranged in line; and controlling the flow of the said short tobacco from the first to the second said container, and feeding it on to the said collecting belt in such a manner as to form on the same, together with the said first stream, a second continuous stream of short tobacco, the ratio of the latter in relation to the said first stream being essentially constant and preset.

The present invention also relates to a cigarette manufacturing machine designed to operate according to the above-mentioned method. With this aim in view, the present invention relates to a cigarette manufacturing machine designed to control the distribution of short tobacco, the said machine comprising an input chamber for a mass of shredded tobacco comprising both long and short tobacco, a collecting belt designed to feed a continuous stream of the said tobacco to a unit for producing a continuous cigarette rod, a first tobacco channel extending between a first point on the said chamber and the said collecting belt, an extracting roller for feeding tobacco from the said first channel to the said collecting belt, a second tobacco channel extending between a second point on the said chamber and the said collecting belt, and separating means at the said second point for separating the long and short tobacco in the mass and enabling only the short tobacco to flow into the said second channel, characterised by the fact that the said second channel comprises a first and second container arranged in line and communicating with each other via an adjustable-section opening; level sensing means being provided for checking the size of the said opening as a function of the level of the said short tobacco inside the said second container; extracting means being provided at the output of the said second channel for extracting the said short tobacco from the said second container and feeding it on to the said collecting belt, and a drive being inserted between the said extracting roller and the said extracting means.

BRIEF DESCRIPTION OF THE DRAWING

A non-limiting arrangement of the present invention will now be described with reference to the attached drawing.

DETAILED DESCRIPTION OF THE INVENTION

The latter shows a cigarette manufacturing machine 1 comprising a distributor 2 for forming, from a mass of shredded tobacco, a continuous stream of tobacco particles. The component parts on distributor 2 are housed in a vertical casing 3 defined topwards by horizontal wall 4 and laterally by two vertical walls 5 and 6.

Wall 4 presents an opening for an input channel 7 at the bottom of which provision is made, inside casing 3, for two power rollers 8 and 9 fitted all round with radial teeth 10.

Rollers 8 and 9 turn in opposite directions for preliminary carding of the tobacco and feeding it towards an underlying input chamber 11 the bottom of which is defined by conveyor belt 12. The latter consists of the essentially horizontal top branch of belt 13 looped round two rollers 14 and 15 one of which is powered.

Chamber 11 houses a toothed carding roller 16 forming part of a carding unit 17 and located at the downstream end of belt 12.

Besides roller 16, unit 17 also comprises a roller 18, known as a metering roller, designed to turn in the same direction as roller 16 and located over and essentially tangent with it.

The effect of such an arrangement is that the tobacco fed by rollers 8 and 9 on to belt 12 is forced by the latter against carding roller 16 which, in turn, conveys out of chamber 11, downstream from its point of tangency with metering roller 18, a layer of tobacco the thickness of which is essentially equal to the radial dimension of its teeth. A toothed roller 19, known as a hurling roller, removes the layer of tobacco off roller 16 and hurls it, in the form of separate particles, into a first tobacco feed channel comprising an input feedbox 20 and an essentially vertical channel 21 defined by two walls 22 and 23.

The bottom end of channel 21 comes out over a toothed extracting roller 24 designed to extract the tobacco from channel 21.

A toothed roller 25, known as a hurling roller, removes the tobacco off the teeth of roller 24 and hurls it, in the form of separate particles, into chamber 26, the bottom wall of which is defined by belt 27, known as a collecting belt and which moves upward from right to left as shown on the attached drawing.

Belt 27 consists of the top branch of a belt 28 looped round two rollers, 29 and 30, at least one of which is powered.

Roller 29 is located at the mid point of an upward channel 31 the top end (not shown) of which communicates with a cigarette rod forming unit (not shown).

As is generally known, on the said cigarette rod forming unit, the tobacco particles cling to the bottom face of at least one suction conveyor belt (not shown).

On the opposite side to that communicating with channel 31, chamber 26 is defined by a fixed sloping wall 32 extending from a point immediately below roller 14 to a point immediately over roller 30, and communicates with the bottom end of a duct or outlet 33 on container or feedbox 34. Inside chamber 26, feedbox 34 is defined, on one side, by wall 32 and, on the other, by wall 35, the top section of which is essentially vertical and terminates immediately below roller 16, and the bottom section of which extends along part of wall 32, so as to define duct 33, and terminates over a toothed hurling roller 36 for extracting tobacco through duct 33.

Roller 36 is turned by roller 24 by means of a mechanical and/or electric drive 37, shown by the dotted line on the drawing and such as to maintain the ratio between the speeds of rollers 24 and 36 essentially constant. The speed of roller 24 is determined by the speed of the drive roller on belt 27.

Between roller 14 and the outer edge of roller 16, provision is made for a separator comprising a scraper comb 38 through which chamber 11 communicates with the input of a second tobacco feed channel comprising a top duct 39 defined by wall 40 curved round a bottom edge portion of roller 16.

At the bottom end of curved wall 40, is hinged a movable plate 41 which, together with a top section of wall 35, defines a store or container 42 which, together with feedbox 34 and duct 39, defines the second said channel. Store 42 is located over and communicates with feedbox 34 through a bottom opening or outlet 43 the size of which is regulated from zero to maximum by plate 41.

The position of plate 41 and, consequently, the size of opening 43, are regulated by an actuator 44 controlled by level detectors comprising two photocells, 45 and 46, inside feedbox 34.

When operated, the tobacco fed on to belt 12 is collected by the same round the edge of roller 16, the teeth of which preferably pick up the long tobacco which is fed towards channel 21 and rollers 24 and 25 by which it is deposited on to belt 27.

The short tobacco, on the other hand, tends to collect on comb 38 through which it drops down into duct 39 and store 42.

The amount of short tobacco flowing out of store 42 is controlled by photocells 45 and 46, in such a manner that the tobacco level inside feedbox 34 remains essentially constant.

As already stated, the speed of roller 36 depends directly on that of roller 24. Consequently, as feedbox 34 is never without short tobacco, on account of the amount collected upstream from feedbox 34 by store 42, a constant supply of short tobacco is fed on to belt 27 upstream from the long tobacco supply point.

In view of the direct relationship between the speeds of rollers 24 and 36 and between the amounts of long and short tobacco blended on belt 27, the same relationship can be maintained constant and set as required, for each batch of tobacco, by adjusting drive 37 so that the proportion of long and short tobacco on belt 27 equals the average proportion of the batch involved.

I claim:

1. Method of manufacturing cigarettes and controlling the distribution of short tobacco, whereby shredded tobacco, comprising both long and short tobacco, is fed on to a collecting belt (27) at the input of a unit for producing a continuous cigarette rod, the said method comprising stages consisting in:

dividing a mass of shredded tobacco, at a point upstream from the said collecting belt (27), in such a manner as to separate the long and short tobacco;

feeding the said long tobacco along a first route and, via extracting means (24), on to the said collecting belt (27) so as to form, on the said belt, a first essentially continuous stream of tobacco;

feeding the said short tobacco along a second route comprising first (42) and second (34) containers arranged in line, said first container (42) having an adjustable section outlet (43);

controlling the flow of the said short tobacco from the first to the second said container (42, 34) through said outlet (43), said flow being regulated by sensors (45) for detecting the tobacco level inside the said second container (34) so as to maintain the said level essentially constant; and feeding said short tobacco on to the said collecting belt (27) in such a manner as to form on the same, together with the said first stream, a second continuous stream of short tobacco, the ratio of the latter in relation to the said stream being essentially constant and preset.

2. Method according to claim 1, characterised by the fact that the said extracting means consist of an extracting roller (24), the said second container (34) having an outlet (33) controlled by a toothed roller (36), the speed of which is a direct function of the speed of the said extracting roller (24).

3. Cigarette manufacturing machine designed to control the distribution of short tobacco, the said machine comprising an input chamber (11) for a mass of shredded tobacco comprising both long and short tobacco, a collecting belt (27) designed to feed a continuous stream of the said tobacco to a unit for producing a continuous cigarette rod, a first tobacco channel (21) extending between a first point on the said chamber (11) and the said collecting belt (27), an extracting roller (24) for feeding tobacco from the said first channel (21) to the said collecting belt (27), a second tobacco channel (39, 42, 34) extending between a second point on the said chamber (11) and the said collecting belt (27), and separating means (38) at the said second point for separating the long and short tobacco in the mass and enabling only the short tobacco to flow into the said second channel (39, 42, 34), characterised by the fact that the said second channel comprises a first and second container (42, 34) arranged in line and communicating with each other via an adjustable-section opening (43); level sensing means (45, 46) being provided for checking the size of the said opening (43) as a function of the level of the said short tobacco inside the said second container (34); extracting means (36) being provided at the output (33) of the said second channel (39, 42, 34) for extracting the said short tobacco from the said second container (34) and feeding it on to the said collecting belt (27), and a drive (37) being inserted between the said extracting roller (24) and the said extracting means (36).

4. Machine according to claim 3, characterised by the fact that the said first container (42) comprises a moving plate (41) defining laterally the said opening (43); actuating means (44) being provided for moving the said movable plate (41) in response to an output signal from the said level sensing means (45, 46).

5. Machine according to claim 3, characterised by the fact that the said extracting means comprise a toothed roller (36) turned by the said drive (37) at a speed depending directly on the speed of the said extracting roller (24).

* * * * *